US010295161B1

(12) United States Patent
Shih

(10) Patent No.: US 10,295,161 B1
(45) Date of Patent: May 21, 2019

(54) ELECTRONIC TRACK LIGHT

(71) Applicant: Dongguan Zhao He Lighting Co., Ltd., Dongguan, Guangdong Province (CN)

(72) Inventor: Ming Feng Shih, Dongguan (CN)

(73) Assignee: Dongguan Zhao He Lighting Co., Ltd., Dongguan (CN)

( * ) Notice: Subject to any disclaimer, the term of this patent is extended or adjusted under 35 U.S.C. 154(b) by 0 days.

(21) Appl. No.: 16/000,548

(22) Filed: Jun. 5, 2018

(30) Foreign Application Priority Data

Jan. 15, 2018 (CN) ..... 2018 1 0034014
Jan. 15, 2018 (CN) ..... 2018 2 0057659 U

(51) Int. Cl.
*F21V 21/15* (2006.01)
*F21V 21/34* (2006.01)
*F21V 21/28* (2006.01)

(52) U.S. Cl.
CPC ..... *F21V 21/15* (2013.01); *F21V 21/28* (2013.01); *F21V 21/34* (2013.01)

(58) Field of Classification Search
CPC ..... F21V 21/15; F21V 21/22; F21V 21/34; F21V 21/28
USPC ..... 362/648
See application file for complete search history.

(56) References Cited

U.S. PATENT DOCUMENTS 5,354,030 A * 10/1994 Harwood ..... F21S 8/06 248/231.51
6,022,130 A * 2/2000 Donato ..... F21S 8/038 362/427
2003/0107888 A1* 6/2003 Devlin ..... F21V 21/15 362/233
2005/0243549 A1* 11/2005 Ruston ..... F21S 2/00 362/233
2007/0268701 A1* 11/2007 Devlin ..... F21V 21/15 362/272
2010/0066267 A1* 3/2010 Meyer ..... H05B 37/0272 315/294
2013/0002166 A1* 1/2013 Meyer ..... H05B 37/0272 315/294
2013/0155672 A1* 6/2013 Vo ..... F21S 8/00 362/233
2017/0307195 A1* 10/2017 Fujisawa ..... F21V 29/76
2017/0307196 A1* 10/2017 Matsui ..... F21V 29/763

* cited by examiner

*Primary Examiner* — Christopher M Raabe
(74) *Attorney, Agent, or Firm* — Lightbulb IP, LLC

(57) ABSTRACT

This innovation includes an electronic track light, including a track box, a rotation clip on the that connects the track box and a track, a pole at a side of the track box and a rotation system at the top of the pole connected to electronic driving machinery. The electronic driving machinery can drive the rotation system to rotate the pole around an axis. There is a swinging system at the bottom of the pole that connects the pole, fixture and the first driving machinery. The first driving machinery can drive the swinging system to different positions. There is a telescopic system in another side of the fixture and a second driving machinery that can drive the telescopic system to move a lens and front frame to different positions. A control unit links and controls the driving machinery and the first and second machineries.

10 Claims, 7 Drawing Sheets

ELECTRONIC TRACK LIGHT

BACKGROUND OF THE INVENTION

1. Cross-Reference to Related Application

This application claims priority to China Patent Application No. 201810034014.3, filed Jan. 15, 2018.

2. Field of the Invention

The invention relates to track lights and in particular to an electronic track light.

3. Related Art

A track light is installed in the track. The track light can adjust the lighting angle according to the location of the object in order to show the best visual effect of the object; Normally, the applications of the track light are the store, exhibition, and museum.

In current situation, the track light can adjust the lighting angle, but this adjustment needs to be through the manual operation.

In order to solve above issue, the China Patent titled "electronic track light" (Patent No. 201610196850.2) shows a kind of electronic track light. This light uses driving machinery 1 to slide the whole track light system along a track. This light uses driving machinery 2 to rotate the fixture from 0 degree to 360 degrees. Moreover, this light uses terminal control units to control the driving machinery 1 and 2, accomplish the intelligent control system to adjust the position and 360 degrees rotation.

However, there are several disadvantages to the above electronic track light. First, the optical unit position in the fixture is fixed. Second, this lighting only can rotate in single plane, cannot rotate in three dimensions. Third, this lighting is not dimmable. Fourth, the exterior is not beautiful.

From the discussion that follows, it will become apparent that the present invention addresses the deficiencies associated with the prior art while providing numerous additional advantages and benefits not contemplated or possible with prior art constructions.

SUMMARY OF THE INVENTION

The subject of this innovation is to solve the drawbacks in current technology. The electronic track light herein has zoomable optical units, good effects and can adjust angle in three dimensional planes.

In order to solve traditional technical drawbacks, the technical scheme for this innovation is an electronic track light, including the track box, the rotation clip on the top of the track box to connect the track box and the track, the pole in one side of the track box, there is a rotation system in the top of the pole. This rotation system connects with the electronic driving machinery (inside the track box). The electronic driving machinery can drive the rotation system, to rotate the pole around its longitudinal axis. There is a swinging system in the bottom of the pole. The swinging system connects the pole, fixture and the first driving machinery (inside the fixture). The first driving machinery can drive the swinging system and to swing the fixture to different positions. There is a telescopic system in another side of the fixture and the second driving machinery inside the fixture. The second driving machinery can drive the telescopic system such that the lens and the front frame extend or retract to different positions along the axis inside the fixture. Moreover, there is a control unit inside the track box which link and control the driving machinery inside the track box, the first and second machineries inside the fixture.

In one or more embodiments, the track box includes the upper caps and the body. There is a space for installing the control unit and the driving machinery. The upper cap fix on the top of the body through the screws. There are two rotation clips on the left side and the right side of the upper cap. These two rotation clips connect the track and the track light system.

In one or more embodiments, the rotating system includes the rotation pedestal, rotation gear, and transmission gear. There is a hole in the bottom of the track box, and this hole is for mounting the rotation pedestal. The rotation pedestal is fixed on the top of the pole and mounted in the hole of the track box. The rotation gear is installed on the rotation pedestal. The rotation gear extends into the track box with a gasket and lock plate that may also be used to mount the rotation gear to the track box. The driving machinery extends down the hole of the track box and connects with the transmission gear. The transmission gear engages the rotation gear. The driving machinery drives the transmission gear, and the transmission gear rotates the rotation gear, which rotates the rotation pedestal and the pole rotate around an axis of the pole.

In one or more embodiments, a groove is between the fixture and the swinging system. The pole extends into the groove and connects the swinging system. The swinging system include the connected pedestal which links the pole, first axis pedestal, and second axis pedestal which are installed at the two sides of the connected pedestal. The first axis pedestal connects the first driving machinery transmission axis. The second axis pedestal connects the rotation pedestal which is extended from the groove side wall. The first driving machinery drives and causes the first axis pedestal, connected pedestal, second axis pedestal, and the rotation pedestal to rotate, then drives the fixture swing.

In one or more embodiments, the fixture includes the body. There is a supporting plate inside the body. The second driving machinery is installed under the supporting plate, and the driving end of the second driving machinery extends through the supporting plate and link the driving gear. The driving gear engages the transmission rack. The second driving machinery drives the driving gear and the transmission rack, which causes the telescopic system and the lens to move along the axis.

In one or more embodiments, the telescopic system includes the sliding plate. There are two sliding grooves at the two side of the sliding plate. There is the installation block in the front of the sliding plate in order to install the lens. There is a rack fix on the sliding plate and in the side of the sliding groove. There are three pillars and sliding paths on the two sides of the supporting plate. The sliding plate is installed on the sliding path and the three pillars are put in the three sliding grooves. When the second driving machinery drives the driving gear and the rotation cylinder, the sliding components and the lens will move along the axis.

In one or more embodiments, both of the driving machinery, first driving machinery, and the second driving machinery are servo driving machinery or servo motors.

In one or more embodiments, a control terminal is included. This control terminal connects the control unit through the wire and wireless method. This control terminal controls the control unit through a remote control method, and the control unit controls the activities of the electronic track lighting.

In one or more embodiments, there are two ways to control and connect the control terminal and control unit. One is through the infrared ray Wi-Fi and remote, and another one is through Bluetooth, Wi-Fi, remote and smartphone.

In one or more embodiments, there is a display device on the bottom of the track box. This display device connects the control unit, and can show the time, signal and connection situation.

The beneficial effects of this innovation include the following. The driving machinery drives and rotates the pole, and the first driving machinery drives and swings the fixture. Therefore, this electronic track system can adjust the lighting angle in three dimensions. The second driving machinery drives and moves the telescopic system and lens along an axis or path. Therefore, the electronic track light can adjust the beam angle degree. The control unit is located inside the track box which can allow the fixture to have a dimmable function. A colorful exterior provides good decoration effect.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE INVENTION

Figure 1:
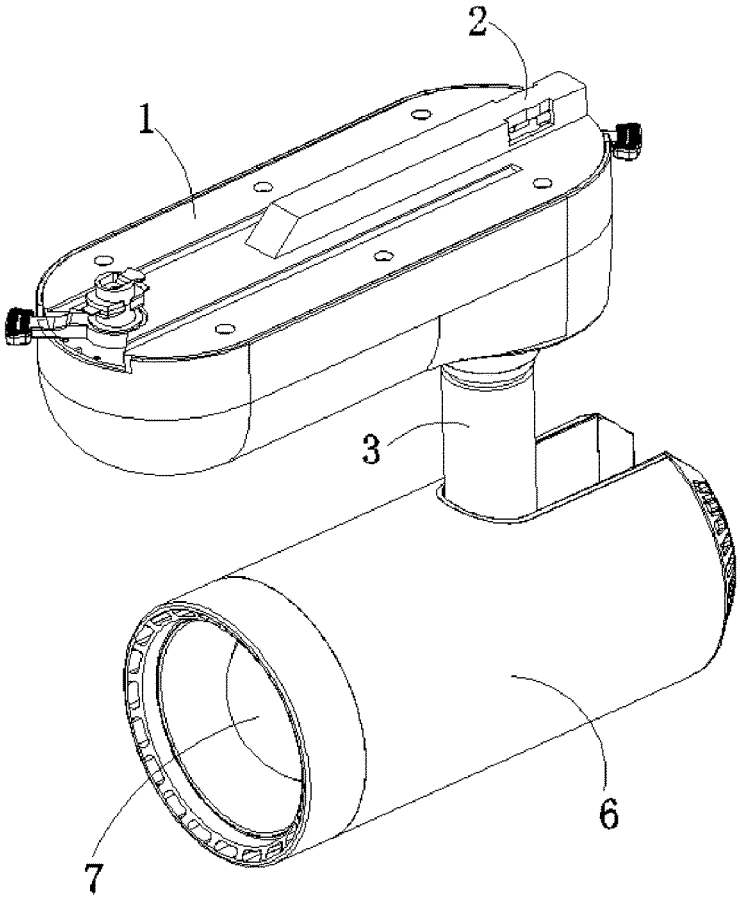
FIG. 1 is a perspective view of an exemplary electronic track light.
Figure 2:
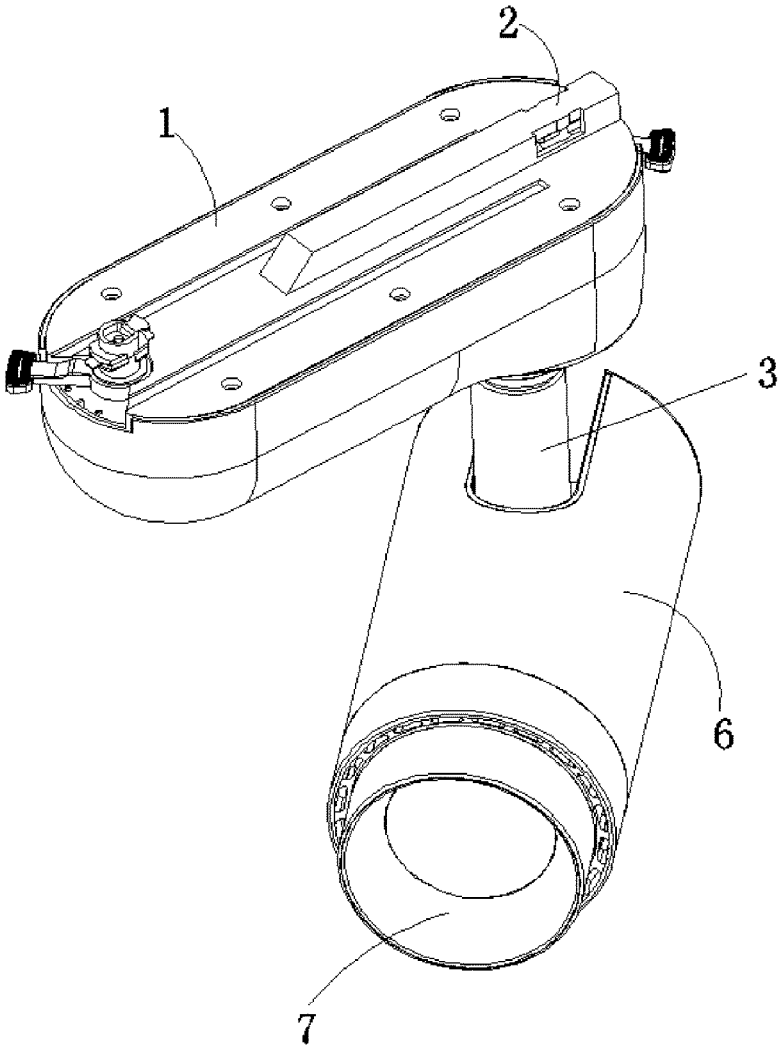
FIG. 2 is a perspective view of an exemplary electronic track light after telescoping.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

The description for the attached figures are only for explanation and demonstration purposes and is not a limitation for this innovation. The following words in this application, namely, "center," "vertical direction," "horizontal direction," "length," "width," "thickness," "up," "down," "forward," "back," "left," "right," "vertical," "horizontal," "upper," "bottom," "inside," "outside," "clockwise," and "anticlockwise" are directions or positions for the figures and these directions or positions are only for the purpose of description of this innovation, instead of a limitation of the innovation. Moreover, the words "first" and "second" are only for the description purposes and does not mean the priority or the quantity of any technical characteristic. Therefore, the words "first" and "second" can mean the characteristic of having one or more. The words "some" or "many" mean the quantity is two or more except in the case of a clearer definition or description. The words "install," "link," "connect," and "fix" are generally used broadly. For example, the word "connect" can mean fixed connection, detachable connection, or on-piece connection; can mean mechanical connection or electric connection; can mean direct connection, medium connection, or two units connection. A person of ordinary skill in this area can realize the meaning of the above words according to an actual situation. Except in cases of clear destination and limitation, the first characteristic up or down the second characteristic can mean the first characteristic connects the second characteristic directly or through another characteristic. The first characteristic being up or on the top of the second characteristic means the first characteristic is right above and oblique above of the second characteristic or the horizontal height of the first driving machinery is higher than the second driving machinery. The first driving machinery is down, on the bottom of the second driving machinery means the first characteristic is right below and oblique below of the second characteristic or the horizontal height of the first driving machinery is lower than the second driving machinery.

As the FIGS. 1-7 illustrate, the electronic track light includes a track box (1). There are two rotation clips (2) in the top of the track box (1). A rotation clip (2) can rotate (relative to the track box (1)). When this rotation clip (2) is clipped into the track, the track box (1) can move along the track. The rotation clip (2) can let the track connect and separate. The pole (3) is installed on another side of the track box (1). There is a rotation system (4) at the top of the pole (3). The rotation system (4) connects the driving machinery (41) which is inside the track box (1). The driving machinery (41) drives the rotation system (4) and causes the pole (3) to rotate around an axis (relative to the track box (1)). There is a swinging system (5) at the bottom of the pole (3). The swinging system (5) connects the fixture (6) and the first driving machinery (51). The first driving machinery (51) is fixed inside the fixture (6). The first driving machinery (51) can drive the swinging system (5) and cause the fixture (6) to swing (relative to the pole (3)). There is a lens (7) inside the fixture (6) (at another side of the swinging system (5)). In this case, the lens (7) is a LED, low pressure sodium lamp, high pressure sodium lamp, or halogen lamp. There is a second driving machinery (8) inside the fixture (6). The second driving machinery (8) drives the telescopic system (9) and causes the lens (7) to move along the axis inside the fixture (6). The driving machinery (41) drives and causes the pole (3) to rotate, the first driving machinery (51) drives and causes the fixture (6) to swing, and the second driving machinery (8) drives and causes the lens (7) to move along the axis. These three activities cause the electronic track light to adjust the lighting angle in three dimensional planes. In this case, all of the driving machinery (41), first driving machinery (51), and the second driving machinery (8) are servo driving machinery or servo motors. The electronic track light includes the control unit (10) and the control terminal (connect the control unit (10) through wire or wireless). The control unit (10) can control the operation of the driving machinery (41), first driving machinery (51), the second driving machinery (8), and the electronic track light. There are two control and connect methods for the control terminal and unit (10). One is through the infrared ray, WIFI, and remote, and another one is through Bluetooth, WIFI, remote, and smartphone.

As the FIGS. 1-5 illustrate, the track box (1) includes the upper cap (11) and the body (12). The upper cap (11) is the black color plastic cap. The body (12) is the bright black color plastic body. There is a space (121) inside the body (12). The control unit (10) and the driving machinery (11) is fixed on the space (121). The upper cap (11) is on the top of the space (11) and fastens through screws. There are two rotation clips (2) installed on the top and the two sides of the upper cap (11). There is a display device on the bottom of the track box (1). This display device connects the control unit (10) and can show the time, signal and connection situation. This display device is a micro screen.

Figure 3:
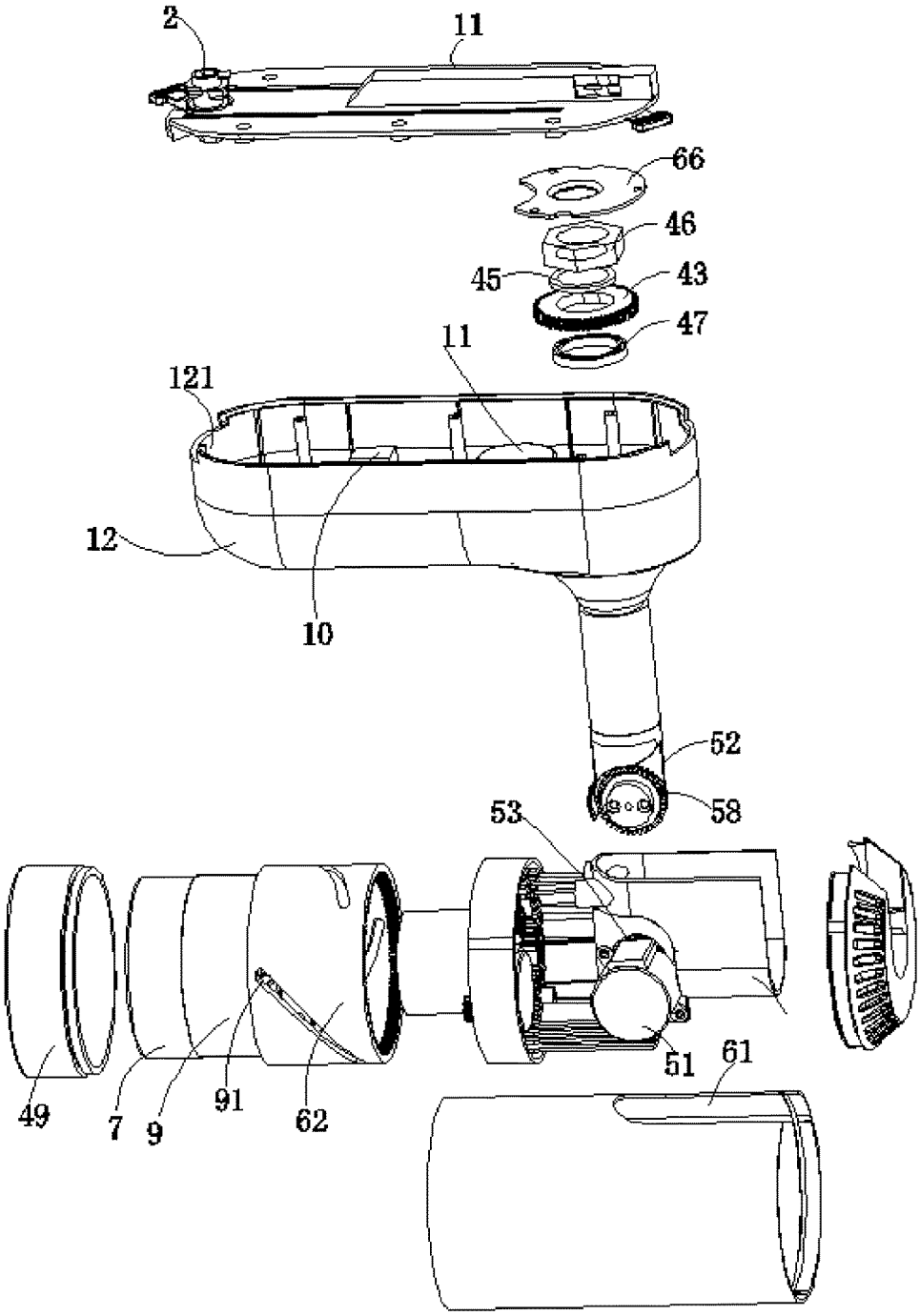
FIG. 3 is an exploded view of FIG. 1.
Figure 4:
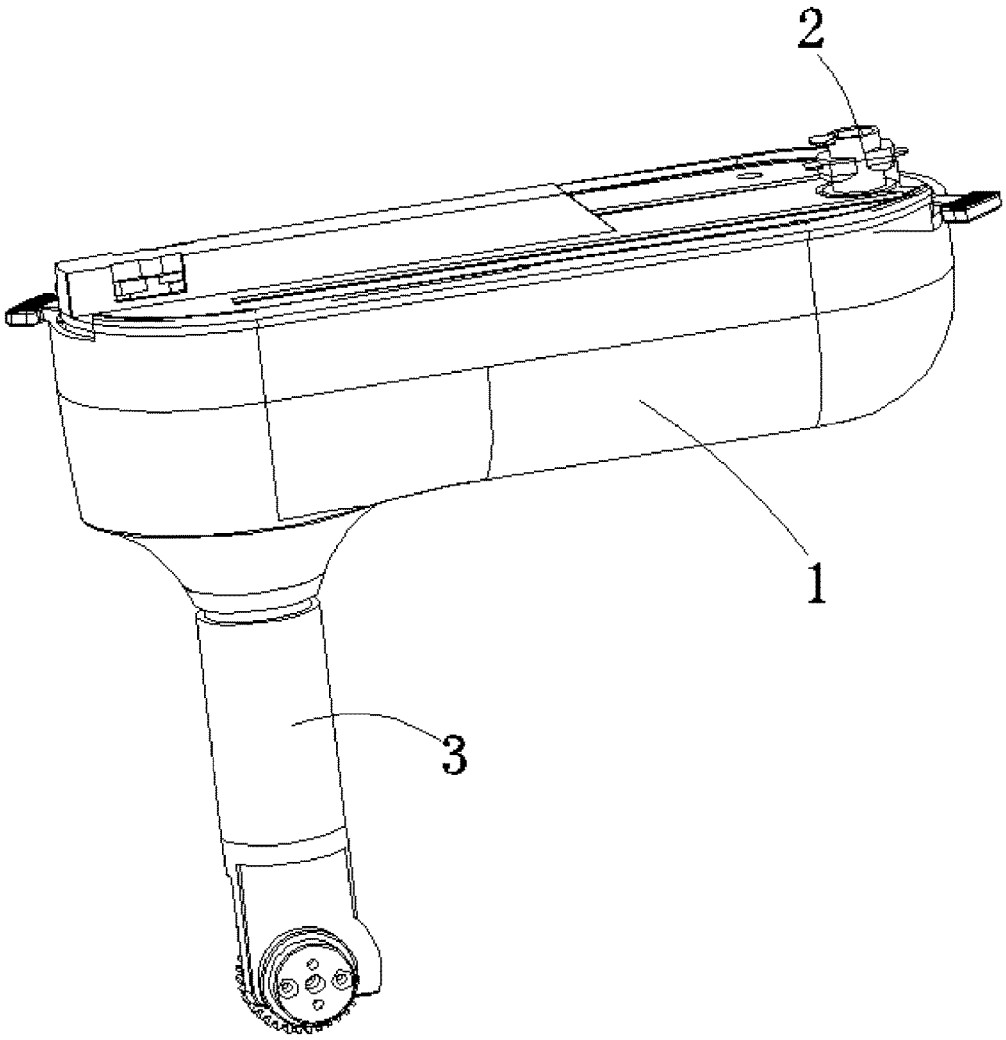
FIG. 4 is a perspective view of an exemplary track box and pole.
Figure 5:
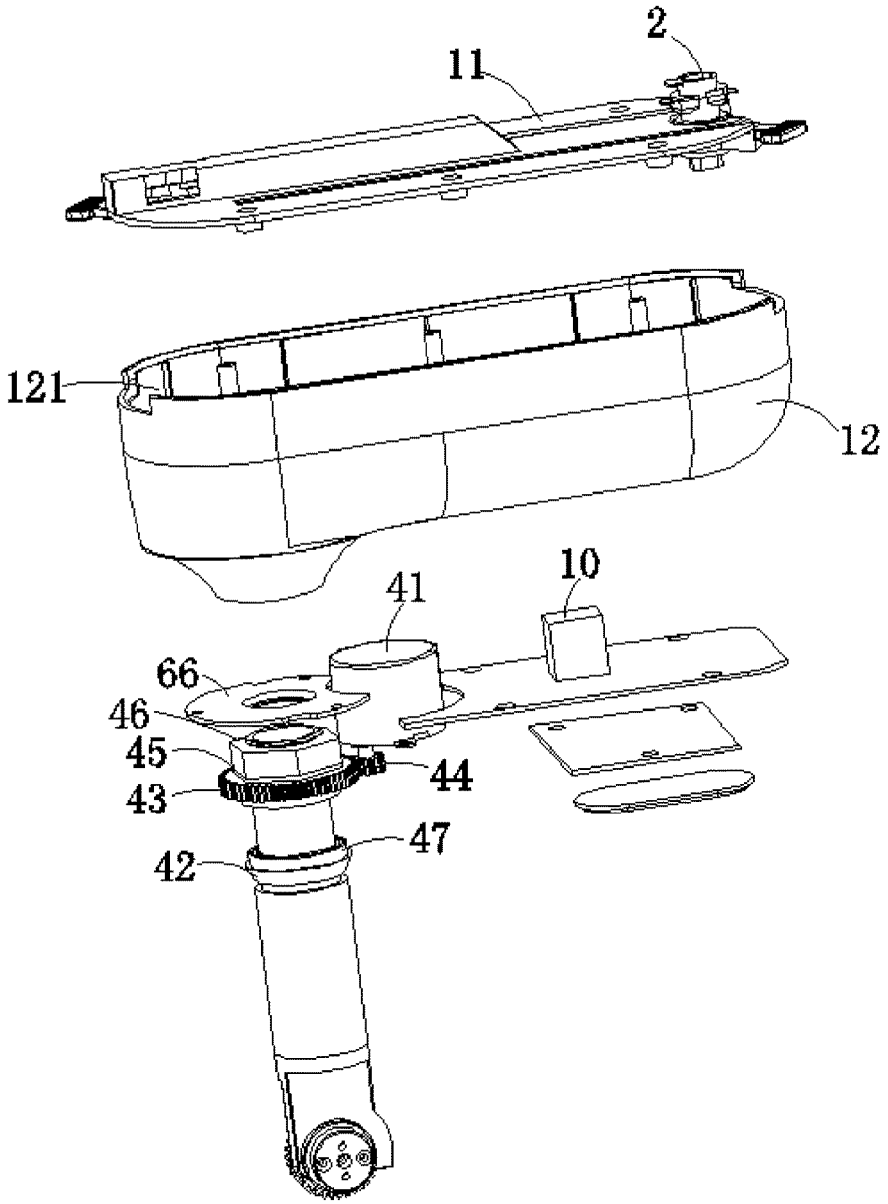
FIG. 5 is an exploded view of FIG. 4.

As the FIGS. 3-5 illustrate, the rotation system (4) includes the rotation pedestal (42), rotation gear (43), and transmission gear (44). There is a mounting hole in the bottom of the body (12). The top of the rotation pedestal (42) mounts in the body (12), and the bottom of the rotation pedestal (42) is fixed on the pole (3). There is a bearing (47) installed on the top of the rotation pedestal (42). There is a rotation gear (43) installed on the rotation pedestal (42). The rotation gear (43) extends into the space (121) and connects the body (12) through the gasket (45) and the lock block (46). The rotation gear (43) connects the body (12), but is not fixed. The rotation gear (43) can rotate (relative to the body (12)). The driving machinery (41) extends down into the mounting hole and connects transmission gear (44). The transmission gear (44) matches or otherwise engages the rotation gear (43). The driving machinery (41) drives the transmission gear (44); the transmission gear (44) drives the rotation gear (43) rotate; the rotation gear (43) drives the rotation pedestal (42); the rotation pedestal (42) drives the pole (3) rotate around the axis. There is a plate (66) in order to prevent the wires from tangling.

As the attached FIGS. 1-3 and 6-7 illustrate, there is a groove (61) at the connection area of the fixture (6) and the swinging system (5). The pole (3) extends into the groove (61) and connects the swinging system (5). The swinging system (5) includes the connection pedestal (55). The first axis pedestal (52) and the second axis pedestal (54) are on the two sides of the connection pedestal (55). The first axis pedestal (52) connects the first driving machinery (51). The second axis pedestal (54) connects the gears (58) which extend from the groove (61) side wall. The first driving machinery (51) drives the first axis pedestal (52), which drives rotation of the connection pedestal (55), second axis pedestal (54), and the gears (58) and the fixture's (6) swing (relative to the pole (3)). The substrate (56) is fixed and inside fixture (6). The first driving machinery (51) is installed on the substrate (56). The first driving machinery (51) extends through the side wall of the substrate (56) and groove (61) and connects the first axis pedestal (52). The gear (58) is located on the relative position of the first driving machinery (51). The gear (58) connects flexibility to the second axis pedestal (54). The second axis pedestal (54) is fixed on the connection pedestal (55). The first driving machinery (51) drives the first axis pedestal (52), then drives the connection pedestal (55) to rotate. Because the connection pedestal is fixed on the pole (3) and the pole (3) only can rotate around the axis, the first driving machinery (51) drives and causes the gear (58), the connection pedestal (55), the first axis pedestal (52) and the second axis pedestal (54) to rotate, then it drives the fixture (6) to swing (relative the pole (3)).

Figure 6:
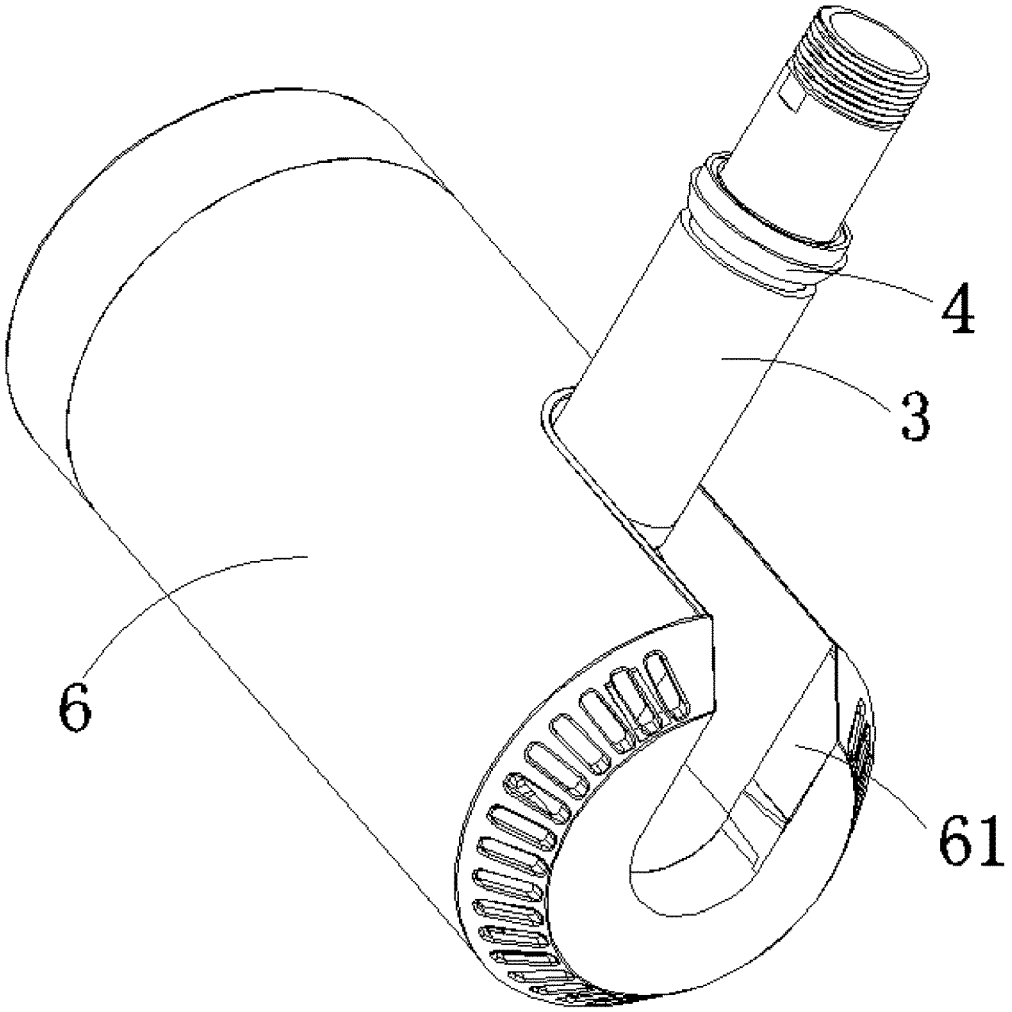
FIG. 6 is a perspective view of an exemplary pole and fixture.
Figure 7:
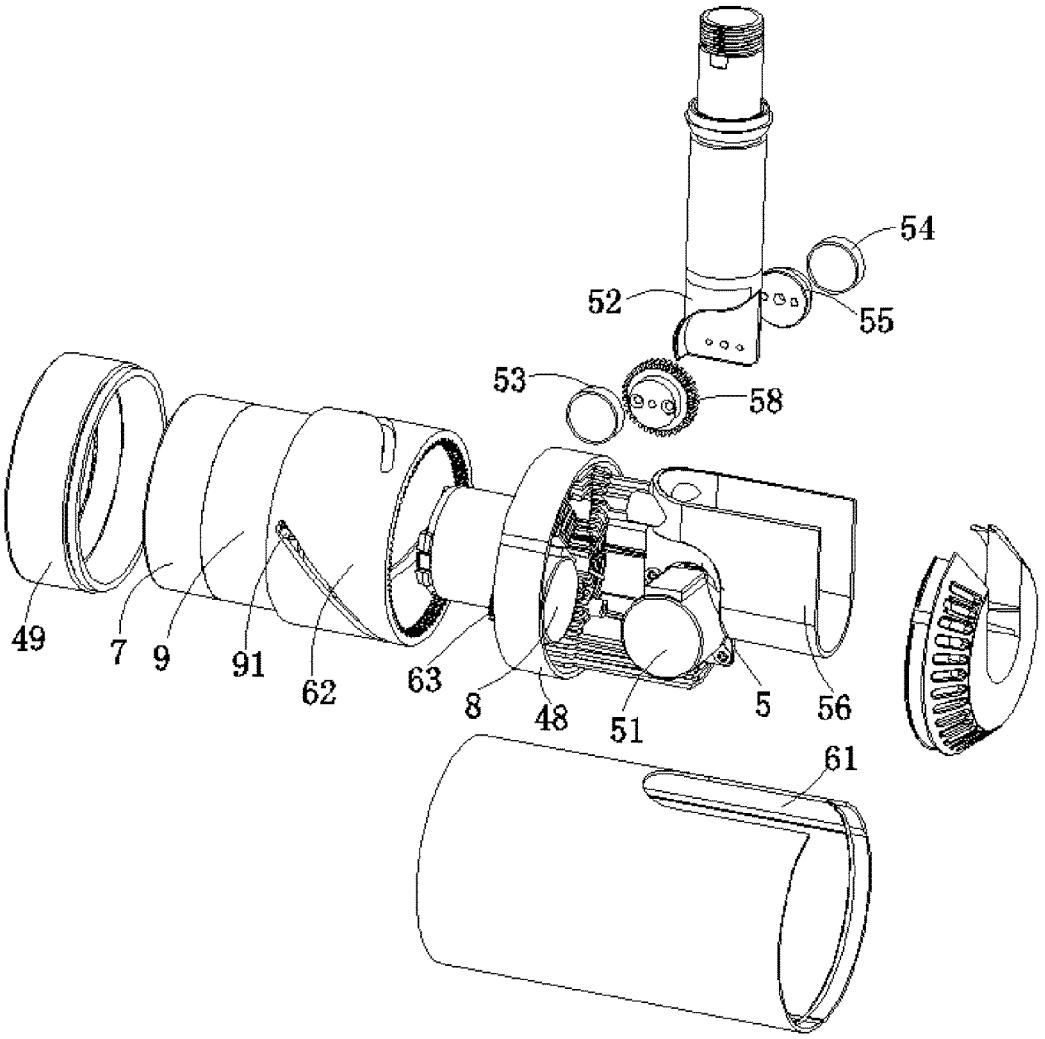
FIG. 7 is an exploded view of FIG. 6.

As the FIGS. 3 and 6-7 illustrate, the fixture (6) includes body (61). The body (61) includes the front cap, rear cap and the middle part. The rear cap and middle part are the matt black plastic material, and the front cap is the bright black plastic material. There is a hole in the front cap in order to allow the lens to retract and extend in and out. There is a heat sink (48) and a rotation cylinder (62) inside the body. The third driving machinery (8) is inside the heat sink (48). The front ring (49) is fastened on the fixture (6) and pushed on the rotation cylinder (62). The transmission of the third driving machinery (8) extends into the rotation cylinder (62). The third driving machinery (8) drives the transmission, which causes the gear (63) to rotate. When the gear (63) rotates, the sliding components (91) will slide along the groove on the rotation cylinder (62). When the sliding components (91) slide along the groove on the rotation cylinder (62), the lens (7) will move in or out. Through this series mechanical workings, the focal length will be adjusted to the right length in order to match the beam angle.

The driving machinery drives and causes the pole to rotate around the axis, the first driving machinery drives and causes the fixture to swing (relative to the pole); these two activities allow the electronic track light to provide lighting angles adjustable in three dimensions. The second driving machinery drives and causes the lens to telescope (relative to the fixture); this activity allows the electronic track light adjust the beam angle. The control unit is inside the track box and can control a light dimming function. Moreover, the exterior of the electronic track light is colorful with good decoration effect.

The above description is not the limit or extent of this innovation. All the alterations, changes, and modifications according to this innovation are included in the range of this innovation. While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An electronic track light comprising:

a track box comprising one or more rotation clips at a top of the track box and electronic driving machinery inside the track box, wherein the one or more rotation clips connect the track box to a track;

a fixture comprising a first driving machinery inside the fixture, a second driving machinery inside the fixture, a front frame, and a lens;

a pole at a side of the track box and extending between the track box and the fixture;

a rotation system at a top of the pole and connected to the electronic driving machinery, wherein the electronic driving machinery drives the rotations system to rotate the pole around a longitudinal axis of the pole;

a swinging system at a bottom of the pole and connected to the pole, the fixture, and the first driving machinery, wherein the first driving machinery drives the swinging system to swing the fixture to a plurality of positions;

a telescopic system at a side of the fixture and connected to the second driving machinery, wherein the second driving machinery drives the telescopic system to extend or retract the front frame and lens along a linear path; and a control unit inside the track box, wherein the control unit controls the electronic driving machinery, the first driving machinery, and the second driving machinery.

2. The electronic track light of claim 1, wherein the track box comprises a body that defines an enclosed space and an upper cap fixed to the body by one or more fasteners, and the one or more rotation clips are at a left side and a right side of the upper cap.

3. The electronic track light of claim 2, wherein the rotation system comprises a rotation pedestal, a rotation gear, and a transmission gear coupled to the rotation gear, a bottom of the track box has a hole, the rotation pedestal is fixed on the top of the pole and mounted in the hole of the track box, the rotation gear is installed on the rotation pedestal and comprises a gasket and lock plate that extend into the track box and mount the rotation gear to the track box, the electronic driving machinery extends down the hole of the track box to connect with the transmission gear, and the electronic driving machinery drives the transmission gear which rotates the rotation gear, the rotation pedestal and the pole about the longitudinal axis.

4. The electronic track light of claim 2 further comprising a groove between the fixture and the swinging system, wherein the pole extends into the groove and connects the swinging system, the swinging system comprises a connected pedestal comprising a first axis pedestal and a second axis pedestal installed on two sides of the connected pedestal, the connected pedestal linking the pole, the first axis pedestal, and the second axis pedestal, the first axis pedestal connects to the first driving machinery, the second axis pedestal connects to the rotation pedestal which extends at a side wall of the groove, the first driving machinery drives the first axis pedestal, the connected pedestal, the second axis pedestal, and the rotation pedestal to rotate, which swings the fixture.

5. The electronic track light of claim 4 further comprising a driving gear coupled to the transmission gear, wherein the fixture comprises a body having a supporting plate therein, the second driving machinery is installed under the supporting plate, and a driving end of the second driving machinery extends through the supporting plate and links the driving gear, and the second driving machinery drives the driving gear and the transmission gear to move the telescopic system and the lens move along the linear path.

6. The electronic track light of claim 5, wherein the telescopic system comprises two sides and a sliding plate having three sliding grooves on the two sides, two installation blocks are in front of the sliding components in order to install the lens, a rack is fixed on the sliding plate and in a side of the three sliding grooves, three pillars and sliding paths are on the two sides of the supporting plate, the sliding components are installed on the sliding path and the three pillars are received in the two sliding grooves, and the second driving machinery drives the driving gear and the rotation cylinder to move the sliding components and the lens along the linear path.

7. The electronic track light of claim 6, wherein the electronic driving machinery, the first driving machinery, and the second driving machinery comprise servo motors.

8. The electronic track light of claim 7, further comprising a control terminal connected to the control unit by a wired or wireless connection, wherein the control terminal remotely controls operation of the electronic track light via the wired or wireless connection.

9. The electronic track light of claim 8, wherein the control terminal is a remote control or smartphone.

10. The electronic track light of claim 9, further comprising a display device at the bottom of the track box that displays time, signal, or connection information, the display device connected to the control unit.

* * * * *